United States Patent [19]

Manno et al.

[11] Patent Number: 5,049,941

[45] Date of Patent: Sep. 17, 1991

[54] TONER SUPPLY CARTRIDGE AND DISPENSING SYSTEM

[75] Inventors: Eugene Manno, Ontario; Joseph G. Mestnik, Rochester, both of N.Y.

[73] Assignee: Xerox Corporation, Stamford, Conn.

[21] Appl. No.: 542,553

[22] Filed: Jun. 25, 1990

[51] Int. Cl.[5] ..... G03G 15/06

[52] U.S. Cl. ..... 355/260; 222/DIG. 1

[58] Field of Search ..... 355/260, 245, 246; 222/167, 170, 456, 650, DIG. 1

[56] References Cited

U.S. PATENT DOCUMENTS

| | | | |
|---|---|---|---|
| 3,043,479 | 7/1962 | Gaukstern | 222/650 X |
| 3,091,371 | 5/1963 | Marx et al. | 222/650 X |
| 3,337,072 | 8/1967 | Del Vecchio et al. | 214/344 |
| 3,339,807 | 9/1967 | Eichorn | 222/171 |
| 4,611,730 | 9/1986 | Ikesue et al. | 222/167 |
| 4,688,926 | 8/1987 | Manno | 355/3 |
| 4,965,639 | 10/1990 | Manno et al. | 355/260 |

FOREIGN PATENT DOCUMENTS

| | | | |
|---|---|---|---|
| 651942 | 11/1962 | Canada | 222/167 |
| 53-90937 | 8/1978 | Japan | 355/260 |

*Primary Examiner*—Joan H. Pendegrass
*Assistant Examiner*—Shuk Y. Lee

[57] ABSTRACT

A reproducing machine has a rotatable toner supply cartridge which dispenses toner into a developer sump, the cartridge being inclined at an angle with respect to the horizontal axis so as to dispense toner assisted by gravity, in controlled amounts only from a dispense port at the end of the cartridge extending below the horizontal. The supply cartridge is modified by the addition of an end cap assembly which incorporates a scoop member which picks up and stores a quantity of toner during rotation. A cog wheel is mounted on the outside of the end cap assembly and is attached to a shaft extending through the end cap assembly. The cog wheel interacts with stepping pins to enable a dispense operation from the scoop member.

3 Claims, 4 Drawing Sheets

TONER SUPPLY CARTRIDGE AND DISPENSING SYSTEM

BACKGROUND AND INFORMATION DISCLOSURE STATEMENT

This invention relates to an apparatus for supplying fresh or makeup toner to a developer system used in a document reproduction machine, and more particularly, to a toner cartridge adapted to selective dispense a quantity of toner into a developer sump.

In xerographic type reproduction machines, latent electrostatic images of the item being copied or printed are generated on a moving recording member such as a photoreceptor through exposure to the document being copied or in accordance with an image signal input. Prior to exposure, the recording member surface is first charged to a desired potential. Following exposure, the latent electrostatic images at the recording member surface are developed at a developing station which, in typical present day practice, comprises one or more magnetic brushes for bringing a developer, usually a mixture of carrier beads and toner, into developing relation with the recording member and the image thereon. Following this, the developed image is transferred at a transfer station to a copy substrate material such as a sheet of paper. After transfer, any remaining developer is removed from the recording member while the developed image previously transferred to the copy substrate material is fixed to provide a permanent copy or reproduction.

In the course of developing images as described above, the toner portion of the developer mixture is periodically depleted and, to maintain the necessary proportion of toner, fresh toner must be added from time to time. Since machines of this type are normally capable of processing several different size images up to a preset maximum, toner depletion may not be uniform across the width of the developer sump.

Various types of toner re-supply systems are known to the prior art as, for example, the canister or cartridge type shown by U.S. Pat. No. 3,337,072 (Del Vecchio et al.). In the Del Vecchio et al. prior art arrangement, a toner supply canister consisting of relatively rotatable inner and outer concentric tubes, each with a toner dispensing opening are used. The supply of fresh toner is held in the inner tube, and by rotating the inner tube relative to the outer tube, the toner dispensing openings in each are brought into alignment. Another toner dispensing system is shown by U.S. Pat. No. 3,339,807 (Eichorn). There, the toner supply canister, once mounted, rotates to bring the toner dispensing holes opposite a series of openings in a stationary grid. Preparatory to this, a tear away strip, which seals the holes during shipment is first removed.

In U.S. Pat. No. 4,688,926, a toner dispensing arrangement is disclosed in which toner is ejected from a rotating cartridge by a toner ejecting rod/cam drive assembly.

The above prior art dispensing arrangement typically utilize the toner dispenser aligned in a horizontal plane. Another variation wherein the dispensing cartridge is inclined or tilted at some small angle to the horizontal is disclosed in co-pending application U.S. Ser. No. 07/426,348 assigned to the same assignee as the present invention. The arrangement disclosed therein shows the toner being dispensed from a plurality of ports formed along the end of the cartridge which extends along the horizontal. U.S. Pat. No. 4,611,730 to Ikesue also discloses, in FIG. 11, a toner dispensing system with the toner cartridge aligned along a non-horizontal plane, but with a different toner exit aperture network. The advantages of the inclined toner system to the horizontal inclined systems to the horizontal systems is that gravity is used to assist the toner dispensing action resulting in a more efficient system. These systems, however, may not provide optimum toner concentration within the toner cartridge along the crucial dispense areas for certain applications.

The present invention is directed towards a modification to the tilted type dispensing system which enables an on-demand toner dispensing action concentrating the toner disposed at a single exit port of the cartridge. The end of the cartridge dispenser is modified by the addition of an end cap assembly which incorporates a scoop segment which picks up and delivers the toner to be dispensed to a single exit port area of the cartridge. In a preferred embodiment, a cog-wheel/pin arrangement is used to periodically open and close the apertures in communication with the exit port in response to a toner dispense signal. More particularly, the invention relates to a copying/printing machine having a movable recording member on which latent electrostatic images are created. developing means for developing said images with toner, and transfer means for transferring developed images to a copy substrate material, said developing means including a developer housing adjacent said recording member with means in said housing to bring developer from a sump in said housing into developing relation with said recording member to develop images on said recording member, the combination of:

a) a tube-like cylinder adapted to contain a supply of fresh toner;

b) means supporting said cylinder in spaced relation above said sump, the axis of said cylinder being at an angle with respect to the horizontal;

c) drive means for rotating said cylinder;

d) said cylinder having a toner discharge opening located at the end of the cartridge lying beneath the horizontal, e) an end cap assembly connected to said end of the cartridge lying beneath the horizontal, said end cap having a scoop element formed therein, said element being a central cavity extending traversely therethrough, said central cavity having a toner entry aperture for introducing toner into said cavity during rotation, and a toner exit aperture at the other end of said cavity, and means for selectively enabling toner from said exit aperture to be dispensed through said cylinder toner discharge opening.

IN THE DRAWINGS

DESCRIPTION OF THE INVENTION

Figure 1:
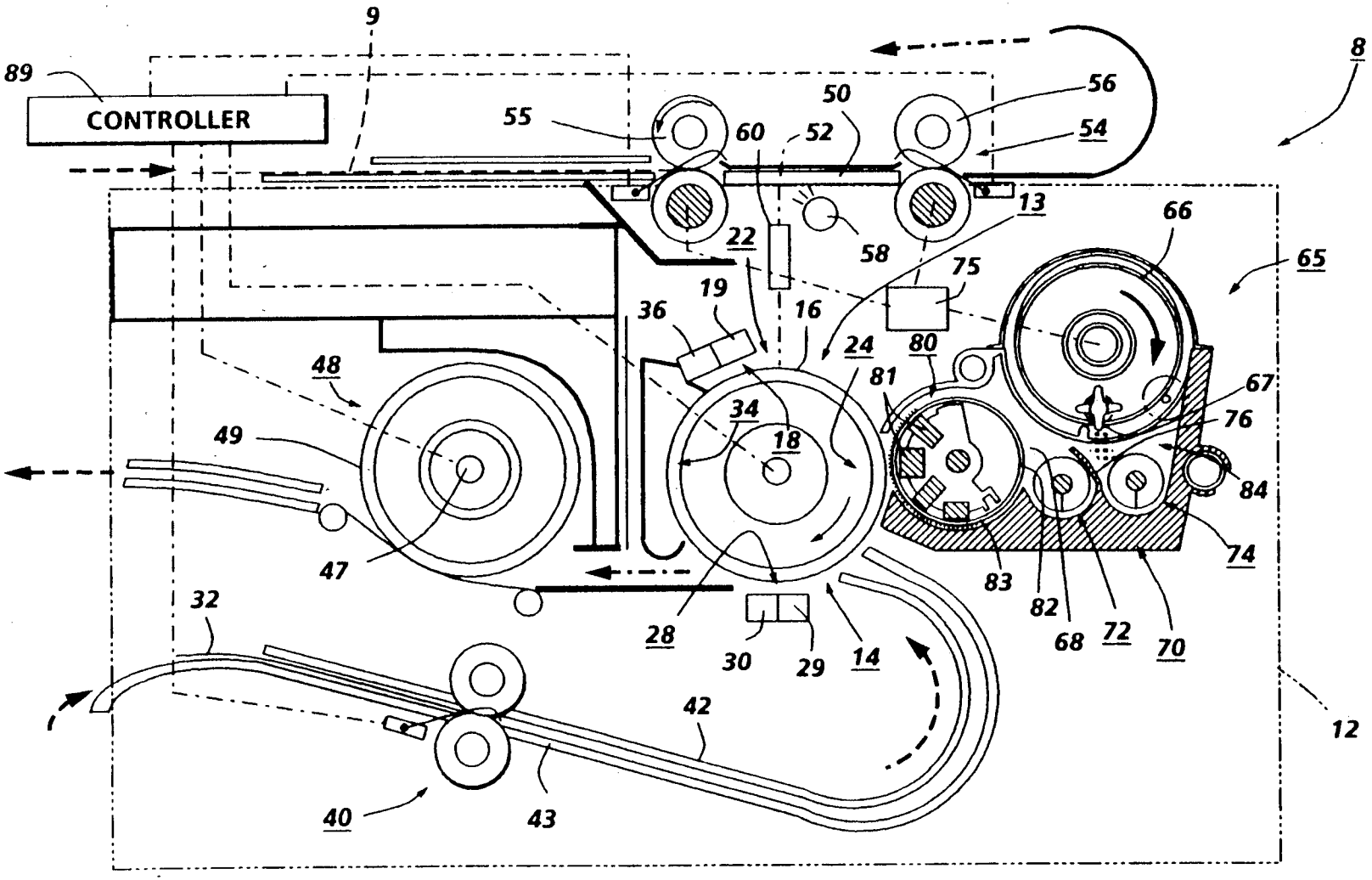
FIG. 1 is a side schematic view in section of a reproduction machine incorporating the toner dispensing cartridge of the present invention.

Referring to FIG. 1 of the drawings, there is shown a xerographic type reproduction machine 8 incorporating the toner supply cartridge assembly of the present invention, designated generally by the numeral 65. Machine 8 has a suitable frame 12 on which the machine xerographic components are operatively supported. Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Operatively disposed about the periphery of photoreceptor 14 are charge station 18 with charge corotron 19 for placing a uniform charge on the photoconductive surface 16 of photoreceptor 14; exposure station 22 where the previously charged photoconductive surface 16 is exposed to image rays of the document 9 being copied or reproduced; development station 24 where the latent electrostatic image created on the photoconductive surface 16 is developed by toner; transfer detack station 28 with transfer corotron 29 and detack corotron 30 for transferring the developed image to a suitable copy substrate material such as a copy sheet 32 brought forward in timed relation with the developed image on photoconductive surface 16, and cleaning station 34 with a cleaning blade and discharge corotron 36.

Copy sheets 32 are brought forward to transfer station 28 by feed roll pair 40, sheet guides 42, 43 serving to guide the sheet through an approximately 180° turn prior to transfer station 28. Following transfer, the sheet 32 is carried forward to a fusing station 48 where the transferred toner image is fixed by fusing roll 49. Fusing roll 49 is heated by a suitable heater such as lamp 47 disposed within the interior of roll 49. After fixing, the copy sheet 32 is discharged.

A transparent platen 50 supports the document 9 as the document is moved past a scan point 52 by a constant velocity type transport 54. As will be understood, scan point 52 is in effect a scan line extending across the width of platen 50 at a desired point along platen 50 where the document is scanned line by line as the document is moved along platen 50 by transport 54. Transport 54 has input and output document feed roll pairs 55, 56, respectively, on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

In the upper part of the assembly 65, a toner dispensing cartridge 66 is rotatably mounted at a slight angle with respect to the horizontal so as to dispense toner particles through discharge port 67 downward into a sump area 68 occupied by a dual auger mixing assembly 70 which includes a pair of rotatably mounted augers 72, 74 separated by a baffle 76. The cartridge 66 is continually rotated by means of a drive motor 75.

Continuing with the description of the developing station 24, a magnetic brush developer roll 80 is disposed in predetermined operative relation with the photoconductive surface 16 of photoreceptor 14 in developer housing 65, the length of developing roll 80 being equal to or slightly greater than the width of photoconductive surface 16, with the axis of roll 80 paralleling the axis of photoreceptor 14. Developer roll 80 has a plurality of stationary magnet assemblies 81 disposed within a rotatable cylinder or sleeve 82 being rotatably journaled for rotation on the opposing sides of developer housing 65. Magnet assemblies 81 are arranged so that as the sleeve 82 rotates, developer is attracted to the exterior surface of the sleeve to form a brush-like covering 83. Rotation of the sleeve 82 carries a developer brush 83 into developing relation with the photoconductive surface 16 of photoreceptor 14 to develop the latent electrostatic image therein.

A suitable controller 89 is provided for operating the various components of machine 8 in the predetermined timed relation with one another to produce copies. In operation, machine 8 is actuated by a suitable start control button. The document to be copied is then inserted into the nip of document transport roll pair 55 which carries the document forward across platen 50. As the leading edge of the document reaches a detector (not shown) controller 89 in response to the signal from a detector, starts feed roll pair 40 to advance the copy sheet 32 forward in timed relation with the document 9 as the document is transported across platen 50 and past scan point 52 by document transport 54. The document image developed on the photoconductive surface 16 of photoreceptor 14 is transferred to copy sheet 32 as the copy sheet moves through transfer station 28. Following transfer, the copy sheet 32 passes to fusing station 48 where the image is fixed.

As toner images are formed and toner depleted, fresh toner is dispensed through aperture 67 in a manner described in further detail below. Auger 74 continually mixes the fresh toner with the denuded carrier particles and existing toner. The mixture transfers into auger 72 and auger 72, rotating in the clockwise direction, effectively forms sump area 68 extending along the length of the auger and of developing roll 80. The toner mixture is then rotatably and axially circulated by auger 72 in close proximity to roll 80. As the roll, or more properly, the sleeve 82 rotates, the toner mixture is distributed to the exterior surface of sleeve 82 to form toner brush 83 which is then rotated into the development zone to form the developed image.

Figure 2:
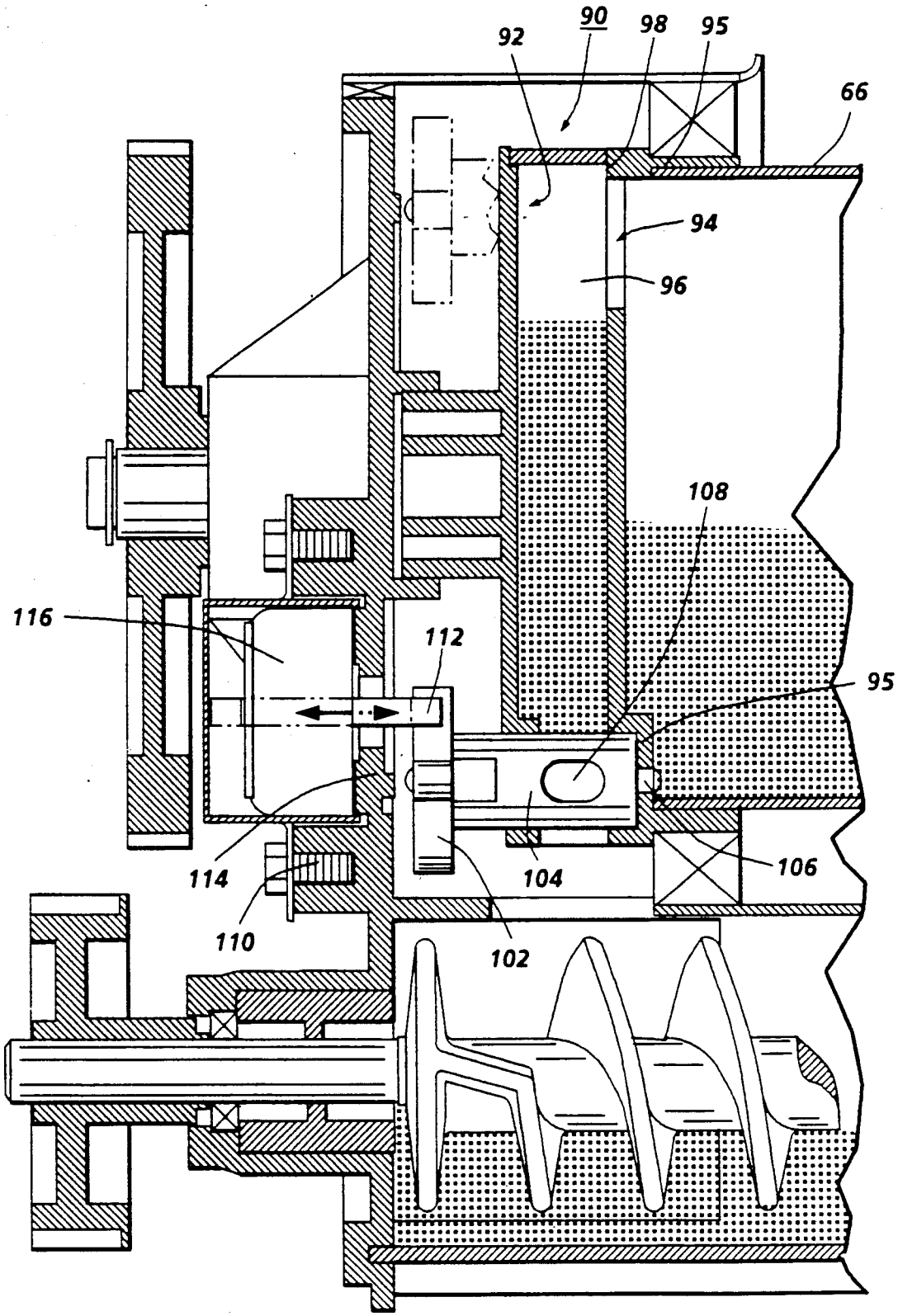
FIG. 2 is a partial isometric side view showing the machine developer section.
Figure 3:
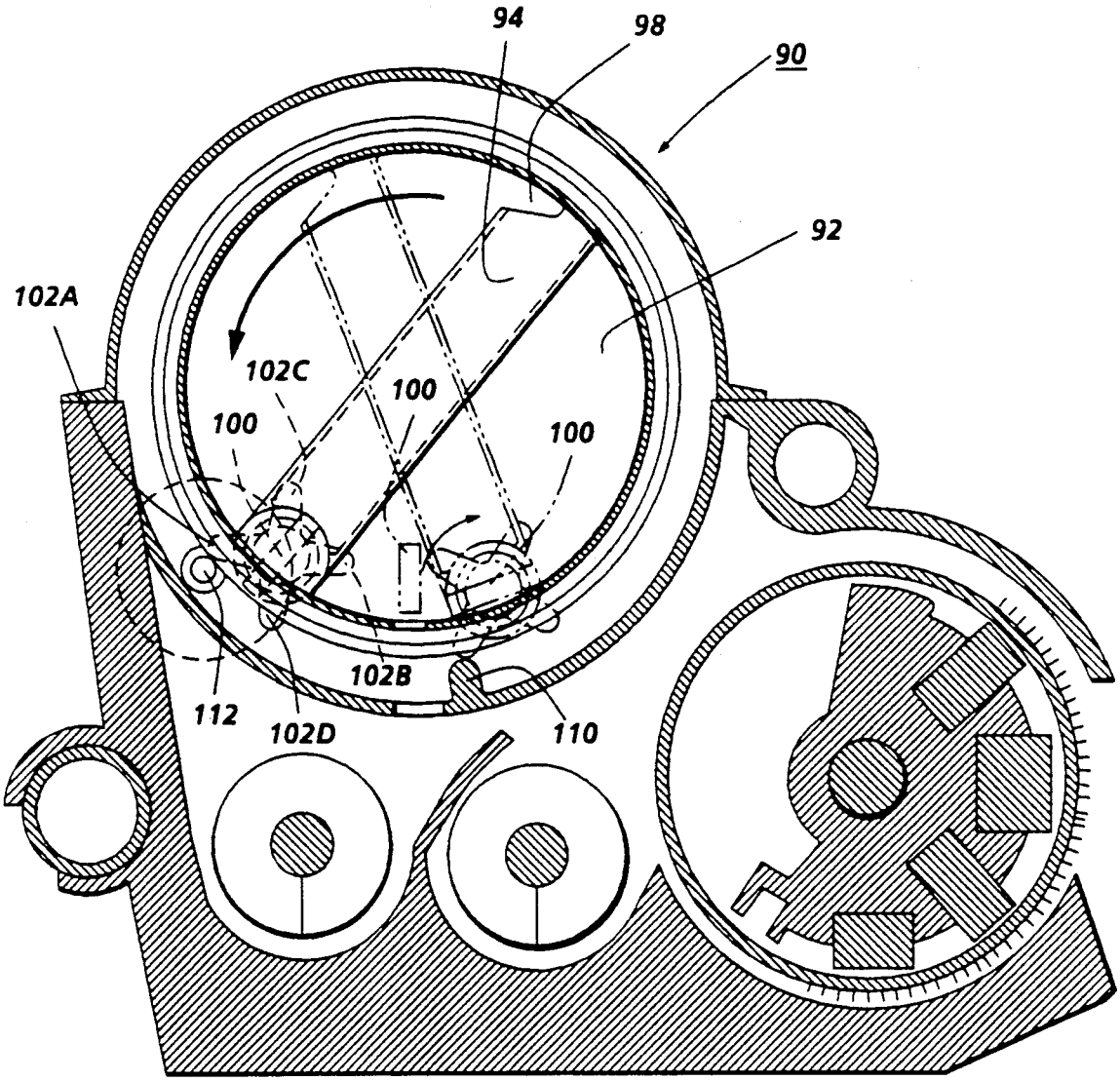
FIG. 3 is a side view of the toner dispensing cartridge of FIG. 1.
Figure 4A:
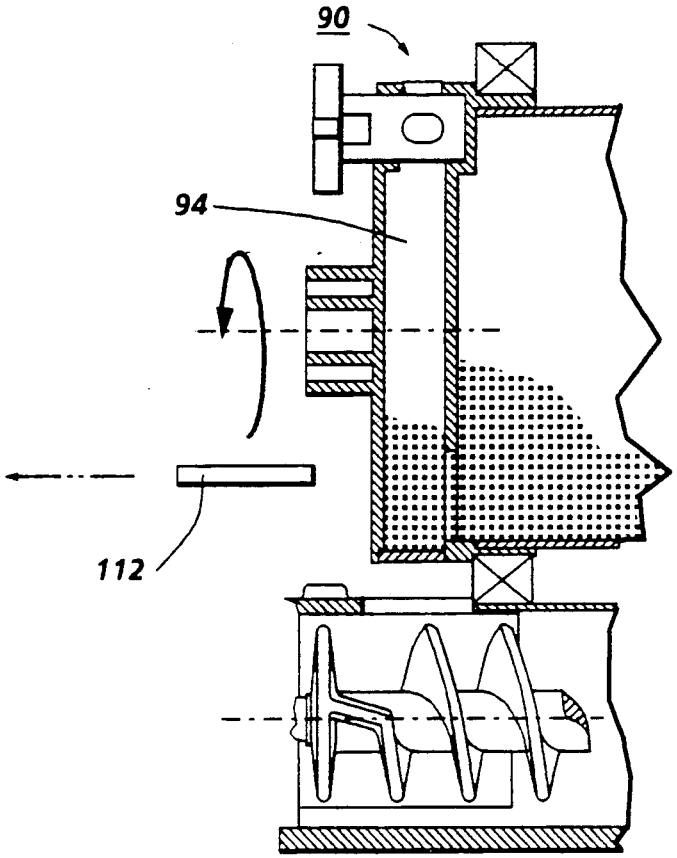
FIG. 4 is an inside end view of the dispensing end of the cartridge of FIG. 1.
Figure 4B:
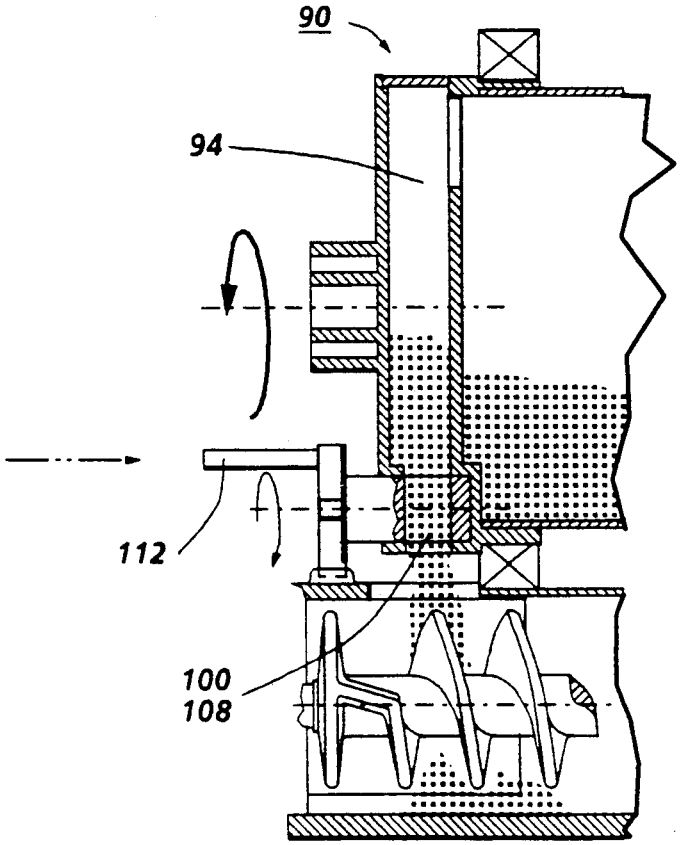

FIG. 2 show a partial isometric side view of the dispensing end of toner cartridge 66 illustrating an end cap assembly 90 attached to the end of cartridge 66. FIG. 3 shows an internal view of end cap 90. FIGS. 4A, 4B show toner just prior to release from the end cap (4A) and during dispensing (4B).

Referring to FIGS. 1–4, end cap assembly 90 is a generally circular cup-like member having an end face 92 to which is attached a toner scoop element 94. The outer lip 95 of the assembly is fixed to the end surfaces of cartridge 66. End cap assembly 90 thus effectively forms an extension of the cartridge. Scoop element 94 has a central cavity 96 extending longitudinally therethrough. One end of passage 96 terminates in toner entry aperture 98 which, as shown in FIGS. 2, and 3, is adapted to scoop toner from the cartridge during rotation. The other end of passage 96 terminates in a toner exit aperture 100. As will be seen, toner is dispensed from aperture 100 into the toner sump under certain conditions.

Continuing with the description of end cap assembly 90, a cog wheel 102 is attached to a spined shaft 104. Cog wheel 102 has four pawls **102*a*, 102*b*, 102*c*, 102*d* of equal length. Shaft 104 extends through the width dimension of assembly 90, and is held in the horizontal alignment shown in FIG. 2 by means of screw 106. Shaft 104 has an aperture 108 extending therethrough. Aperture 108, in a non-dispensing mode, is out of alignment with exit aperture 100 thereby confining toner to the central cavity area 96 of scoop element 96. When aperture 108 is brought into alignment with the exit aperture 100 under the conditions described below, toner dispensing will occur into the sump area 68**.

Referring now to FIGS. 3 and 4, the interaction of cog wheel 102 with stepping pins 110, 112 may be discerned. A first stepping pin 110 is mounted in a fixed location on frame 114. Pin 112 is connected to solenoid 116 also secured in frame 114. Solenoid 116 is electrically connected to controller 89. The interaction of cog wheel 102 with pins 110, 112 is best understood by describing an operational cycle. As shown in FIG. 1 cartridge 66 is inclined at some small angle (4° has been found to be effective) to the horizontal. The toner within the cartridge is thus concentrated within the end extending below the horizontal axis, and particularly within the cup portion of end cap assembly 90. Cartridge 66 is rotatably supported in an appropriate bearing journals in opposed sides of developer housing 65. The cartridge can be rotated either continuously or intermittently. During rotation, toner is scooped up by scoop element 94 through toner entry aperture 98 during the downward arc of rotation. The scooped up toner falls through central passage 96 and accumulates at the bottom thereof until the toner dispensing is initiated. During non-dispense operation, aperture 108 of cog wheel shaft 104 is in non-alignment with exit aperture 100 of scoop element 94. Hence, no toner can exit through exit port 67. The pawls 102*a*–102*d* are aligned so as to clear the fixed pin 110, solenoid pin 112 being in the retracted position. At some point during operation an ADD TONER SIGNAL is sent to controller 89 using any of the conventional toner depletion methods employed in the prior art to generate this signal. One example could be a photosensor arrangement in the toner sump to detect changes in the developer density. Upon receipt of an ADD TONER SIGNAL, controller 89 sends a signal to solenoid 116 energizing the solenoid and moving pin 112 a short distance inwards toward end cap assembly 90, and into the path of the rotating pawls of cog wheel 102. FIG. 3 shows the position of the cog wheel as pawl 102*a* (or any of the other pawls which happen to be in position) encounters pin 112. The pawl steps over the pin, rotating shaft 104 and causing aperture 100 of the scoop element to be aligned horizontally with aperture 108 and shaft 104. This shaft movement creates the aforementioned condition wherein the toner contained within central cavity 96 of scoop element 94 is free to fall by gravity through toner dispense port 67 of cartridge 66. The dispensing action continues until pawl 102*b* strikes fixed pin 110. This action restores the non-alignment condition just before solenoid pin 112 was energized, e.g., the condition wherein apertures 100 and 108 are in non-alignment. Solenoid 116 may either stay energized in response to a continued indication of toner replenishment need or may be inactivated retracting pin 112. With continued rotation, scoop element picks up additional toner on its next excursion and another dispense cycle can be executed when the cog wheel constitutes a full rotation back to the encounter with pin 112 if pin 112 is still in the activated condition.

It is seen that an efficient toner dispensing toner operation is enabled which provides concentrated toner dispensing operation in a on-demand type of environment. Some systems may operate in the context of the toner cartridge only being periodically rather than continuously rotated, and is apparent from a consideration of FIG. 4, the dispensing interval may be extended or reduced simply by changing the relative location of pins 110, 112.

While the invention has been described with reference to the structure disclosed, it will be appreciated that numerous changes and modifications are likely to occur to those skilled in the art, and it is intended to cover all changes and modifications which fall within the true spirit and scope of the invention.

We claim:

1. In a copying/printing machine having a movable recording member on which latent electrostatic images are created, developing means for developing said images with toner, and transfer means for transferring developed images to a copy substrate material, said developing means including a developer housing adjacent said recording member with means in said developer housing to bring developer from a sump in said housing into developing relation with said recording member to develop images on said recording member, the combination of:

a) a tube-like cylinder adapted to contain a supply of fresh toner;

b) means supporting said tube-like cylinder in spaced relation above said sump, the axis of said cylinder being at an angle with respect to the horizontal;

c) drive means for rotating said cylinder;

d) said cylinder having a toner discharge opening located at the end of the cylinder lying beneath the horizontal;

e) an end cap assembly connected to said end of the cylinder lying beneath the horizontal, said end cap having a scoop element formed therein, said element being a central cavity extending traversely therethrough, said central cavity having a toner entry aperture for introducing toner into said cavity during rotation, and a toner exit aperture at the other end of said cavity, and means for selectively enabling toner from said exit aperture to be dispensed through said cylinder toner discharge opening.

2. The printing machine of claim 1 wherein said selectively enabling means includes a cog wheel rotatably mounted to a shaft extending through said end cap assembly, said cog wheel having a plurality of pawls extending radially outward from the cog wheel center, said pawls moving through a rotational path when said cog wheel is rotated, said shaft having an aperture therethrough which, during non-dispense operation, is in non-alignment with said exit aperture, but during dispensing operation is in alignment with said exit aperture, said enabling means including at least two pins positioned along the rotational path of said pawls, said pins lying outside of the area of said pawl rotation during non-dispense operation, said enabling means further including control means for placing one of said pins into the path of said cog wheel rotation wherein one of the pawls strikes one of said pins causing said exit aperture and said shaft aperture to become aligned permitting dispensing to occur through said cartridge dispense port until the cog wheel pawl steps over a fixed pin restoring the misalignment of said shaft aperture and exit aperture.

3. A toner dispensing cartridge comprising:

a tube-like cylinder adapted to contain a supply of toner; said cylinder having a toner discharge at one end and an end cap assembly connected to said end of the cartridge, said end cap having a scoop element formed therein, said element being a central cavity extending traversely therethrough, said central cavity having a toner entry aperture for introducing toner into said cavity during rotation, and a toner exit aperture.

* * * * *